US011262034B2

(12) United States Patent
Yang et al.

(10) Patent No.: US 11,262,034 B2
(45) Date of Patent: Mar. 1, 2022

(54) LIGHTING MODULE AND LIGHTING FIXTURE

(71) Applicant: OPPLE LIGHTING CO., LTD., Shanghai (CN)

(72) Inventors: Hongfu Yang, Shanghai (CN); Zhanguo Liu, Shanghai (CN); Guoping Zhang, Shanghai (CN); Cong Wang, Shanghai (CN); Kai Wang, Shanghai (CN); Chuan Liang, Shanghai (CN)

(73) Assignees: Oppie Lighting Co., Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 0 days.

(21) Appl. No.: 16/899,578

(22) Filed: Jun. 11, 2020

(65) Prior Publication Data

US 2020/0309332 A1 Oct. 1, 2020

Related U.S. Application Data

(63) Continuation of application No. PCT/CN2018/119402, filed on Dec. 5, 2018.

(30) Foreign Application Priority Data

Dec. 11, 2017 (CN) ..... 201721710322.0

(51) Int. Cl.
*F21S 8/02* (2006.01)
*F21V 29/74* (2015.01)
*F21V 29/83* (2015.01)

(52) U.S. Cl.
CPC ..... *F21S 8/026* (2013.01); *F21V 29/74* (2015.01); *F21V 29/83* (2015.01)

(58) Field of Classification Search
None
See application file for complete search history.

(56) References Cited

U.S. PATENT DOCUMENTS 6,431,728 B1 * 8/2002 Fredericks ..... B60Q 1/2696 340/901
7,963,672 B2 * 6/2011 Liu ..... F21V 19/0055 362/249.02

(Continued)

FOREIGN PATENT DOCUMENTS

CN 101363595 A 2/2009
CN 201373361 Y 12/2009

(Continued)

OTHER PUBLICATIONS

International Search Report of PCT Application No. PCT/CN2018/119402 dated Mar. 7, 2019, (4p).

*Primary Examiner* — Elmito Breval
(74) *Attorney, Agent, or Firm* — Arch & Lake LLP

(57) ABSTRACT

An illumination module and a lamp, the illumination module is adapted to be assembled with at least two different installation components. The illumination module includes: a housing including a main body part, a side wall extending from the main body part, and an installation region for disposing the installation components, the installation region includes a first installation part and a second installation part, the first installation part is located on an outer periphery of a back face of the main body part of the housing and configured to be assembled with an installation component, and the second installation part is located on the side wall at the back face of the housing and configured to assemble with an installation component; and a light source component, installed on a front face of the main body part of the housing.

20 Claims, 5 Drawing Sheets

(56) References Cited

U.S. PATENT DOCUMENTS 8,025,422 B1 * 9/2011 Huang ..... F21V 29/763 362/241
8,267,544 B2 * 9/2012 Zheng ..... F21V 23/008 362/249.02
8,770,774 B2 * 7/2014 Ye ..... F21V 33/0096 362/96
9,022,621 B2 * 5/2015 Boyer ..... F21V 5/04 362/362
9,279,578 B2 * 3/2016 Bertin ..... F21S 8/032
9,518,724 B2 * 12/2016 Kwak ..... F21V 21/00
9,869,435 B2 * 1/2018 DeCarr ..... F21V 15/01
10,330,303 B2 * 6/2019 Kwak ..... F21V 29/506
2009/0262542 A1 * 10/2009 Li ..... F21V 3/00 362/373
2010/0020542 A1 * 1/2010 Teng ..... F21V 15/015 362/249.05
2010/0296287 A1 * 11/2010 Huang ..... F21V 15/013 362/249.02
2011/0110081 A1 * 5/2011 Belknap ..... F21V 11/14 362/235
2011/0141728 A1 * 6/2011 Russello ..... F21V 29/75 362/235
2011/0317425 A1 * 12/2011 Jeon ..... F21V 23/007 362/249.05
2012/0182744 A1 * 7/2012 Santiago ..... F21V 21/048 362/365
2012/0188766 A1 * 7/2012 Lu ..... F21V 29/763 362/249.02
2012/0218758 A1 * 8/2012 Wang ..... F21S 8/086 362/244
2013/0088871 A1 * 4/2013 Yun ..... F21V 29/51 362/249.01
2013/0135865 A1 * 5/2013 Lin ..... F21V 29/75 362/249.02
2013/0155673 A1 * 6/2013 Wang ..... F21V 17/02 362/235
2013/0242574 A1 * 9/2013 Guercio ..... F21V 29/83 362/373
2014/0036504 A1 * 2/2014 Kim ..... F21V 31/005 362/249.02
2015/0184808 A1 * 7/2015 Wang ..... F21V 29/74 362/235
2015/0204521 A1 * 7/2015 Zhang ..... F21V 21/28 362/294
2015/0345773 A1 * 12/2015 Kang ..... F21V 17/12 362/267
2016/0025286 A1 * 1/2016 Wang ..... F21K 9/20 362/225
2017/0227207 A1 * 8/2017 Bendtsen ..... F21V 23/003
2018/0058636 A1 3/2018 Wang et al.

FOREIGN PATENT DOCUMENTS

CN 102352997 A 2/2012
CN 106224905 A 12/2016
CN 205939003 U 2/2017

* cited by examiner

LIGHTING MODULE AND LIGHTING FIXTURE

CROSS-REFERENCE TO RELATED APPLICATIONS

The application is based upon and claims priority to PCT patent application No. PCT/CN2018/119402 filed on Dec. 5, 2018 which claims the priority of Chinese Patent Application No. CN201721710322.0, filed on Dec. 11, 2017, the entire contents of which are incorporated herein by reference for all purposes.

FIELD OF TECHNOLOGY

The present application relates to a technical field of an illumination module, and in particular to an illumination module and a lamp capable of installing various installation components.

BACKGROUND

With the continuous development of the lamp, the lamp which can be provided with various installation components have emerged to adapt to different installation ways.

For example, as shown in FIG. 1, an outdoor lamp which can be installed by various installation ways includes a lamp body 1' and an electrical box 2' installed on a top of the lamp body 1'. In addition, the outdoor lamp further includes a hook 3', I-shaped slots 4 'and a bearing 5'. The hook 3' is installed on a top of the electrical box 2' by a fastener. Two I-shaped slots 4' are disposed and are installed on both sides of the electrical box 2' along a center line. The bearing 5' includes a bracing frame and buckles. The bracing frame is I-shaped, and a plurality of vias are disposed on an upper end face of the bracing frame. Two buckles are disposed, which are respectively installed on lower inner sides of end faces on both sides of the bracing frame to engage with the I-shaped slots 4'.

The hook 3' is disposed on the top of the electrical box 2', to facilitate to install and disassemble the outdoor lamp which is installed in suspension form; meanwhile, the I-shaped slots 4' are disposed on both sides of the electrical box, and the bearing 5' is installed on the electrical box 2' by the I-shaped slots 4', so that the outdoor lamp is fixed to a wall or the ground by the bearing 5' and can be used as a floodlight or other illumination ways, which facilitates to use in the work place.

However, for the outdoor lamp, because only the hook and the bearing are disposed, the high bay lamp can only be installed by the above two ways, leading to fewer installation ways.

SUMMARY

Embodiments of the present application provide an illumination module, which is used to solve the problem of fewer installation ways of the outdoor lamp in the prior art.

The following technical solutions are adopted by the embodiments of the present application.

An illumination module adapted to be assembled with at least two different installation components of the present application includes: a housing including a main body part, a side wall extending from the main body part, and an installation region for disposing the installation components. The installation region includes a first installation part and a second installation part, the first installation part is located on an outer periphery of a back face of the main body part of the housing and configured to be assembled with an installation component; the second installation part is located on the side wall at the back face of the housing and configured to be assembled with an installation component. The illumination module also includes a light source component that is installed on a front face of the main body part of the housing.

A lamp of the present application includes the illumination module according to any one of the above illumination modules and an installation component fixed to the installation region of the illumination module.

BRIEF DESCRIPTION OF THE DRAWINGS

The drawings described here are used to provide a further understanding of the present application and form a part of the present application. The illustrative embodiments and descriptions of the present application are used to explain the present application and do not constitute a limitation on the present application. In the drawings:

FIG. 1 to FIG. 10 includes:

Figure 1:
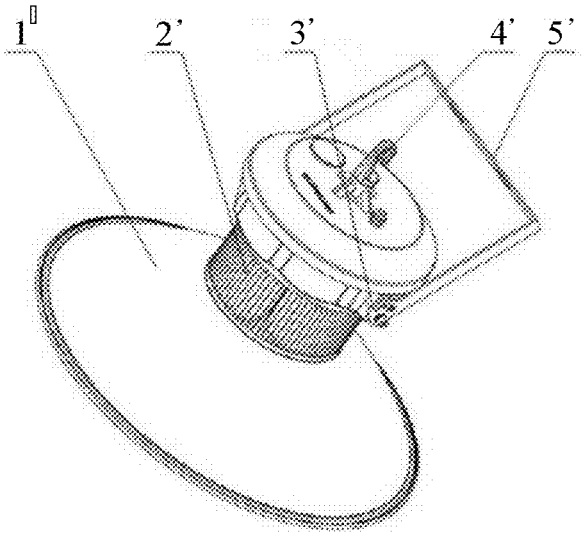
FIG. 1 is a schematic structural diagram of an outdoor lamp in prior art.
Figure 2:
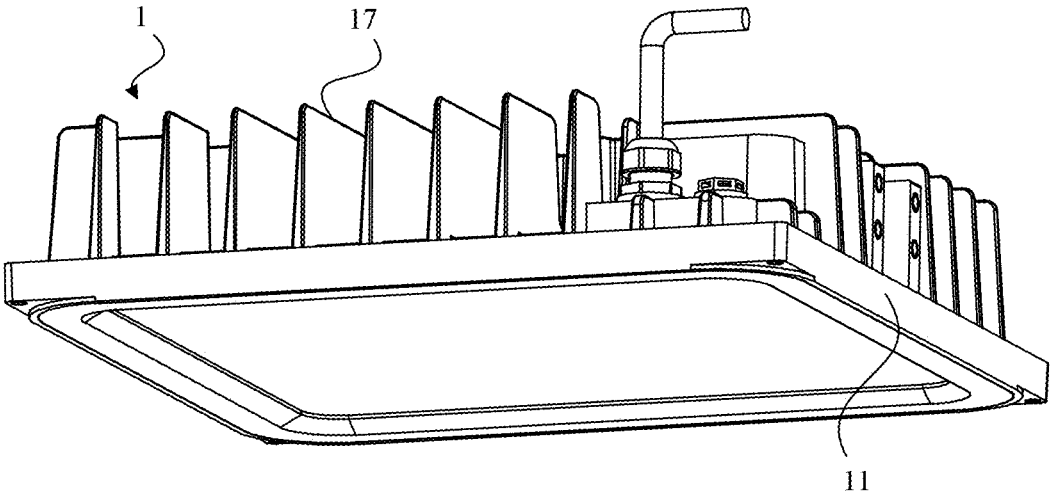
FIG. 2 is a schematic structural diagram of an illumination module in a first direction according to an embodiment of the present application.
Figure 3:
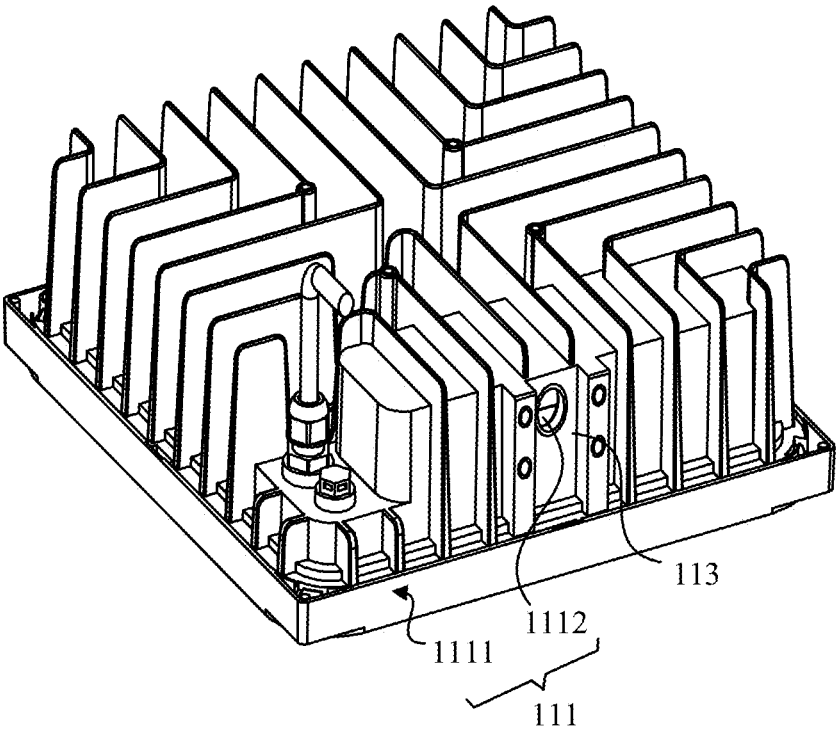
FIG. 3 is a schematic structural diagram of an illumination module in a second direction according to an embodiment of the present application.
Figure 4:
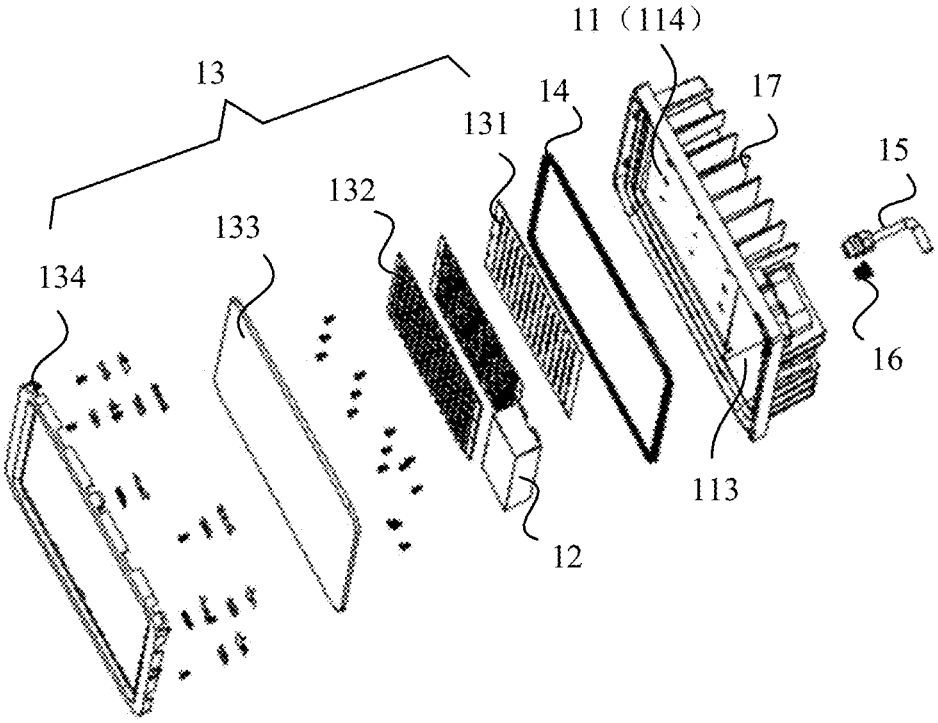
FIG. 4 is a schematic diagram of an explosion structure of an illumination module according to an embodiment of the present application.

lamp body—1'; electrical box—2'; hook—3'; I-shaped slot—4'; bearing—5'; illumination module—1; installation component—2; housing—11; power supply—12; light source component—13; waterproof silicone ring—14; water joint—15; respirator—16; heat sink—17; installation region—111; heat dissipation region—112; power supply accommodation groove—113; main body part—114; light source—131; lens—132; glass shade—133; glass cover plate—134; support—211; connection ear—212; mask—221; ceiling box—222; installation plate—223; side plate—224; lamp rod—231; fixing base—232; first installation part—1111; second installation part—1112; panel—2111; vertical plate—2112; fixing plate—2113.

DETAILED DESCRIPTION

In order to make objects, technical details and advantages of the embodiments of the application apparent, the technical solutions of the embodiments will be described in a clearly and fully understandable way in connection with the drawings related to the embodiments of the application. Apparently, the described embodiments are just a part but not all of the embodiments of the application. Based on the described embodiments herein, those skilled in the art can obtain other embodiment(s), without any inventive work, which should be within the scope of the application.

The technical solution adopted in the embodiments of the present application can achieve the following beneficial effects: the housing includes a main body part and a side wall extending from the main body part, and an installation region for installing installation components is disposed on the housing. The installation region includes a first installation part on the outer periphery of the back face of the main body part of the housing for assembling with an installation component, and a second installation part on the side wall of the back face of the housing for assembling with an installation component. In this way, different installation components can be installed on the illumination module according to the installation way required by the illumination module. For example, when the illumination module needs embedded installation, the installation component is disposed to a support structure; when the illumination module needs ceiling-mounted installation, the installation component is disposed to a mask structure; when the illumination module is used as a street lamp, the installation component is disposed to a lamp rod structure. Therefore, various installation ways of the illumination module can be achieved.

As shown in FIG. 2 to FIG. 5, the illumination module 1 of the present application is fixedly installed to, for example, a house, a lamp stand, etc. by an installation component 2. The illumination module 1 includes a housing 11 provided with a main body part 114 and a side wall extending from the main body part, and a light source component 13 installed on a front face of the main body part 114 of the housing 11. The housing 11 is provided with an installation region 111. The installation region 111 includes a first installation part 1111 and a second installation part 1112. The first installation part 1111 is located on an outer periphery of a back face of the main body part 114 of the housing 11 and is configured to assemble with the installation component 2, and the second installation part 1112 is located on a back side wall of the housing 11 and is configured to assemble with the installation component 2. In this way, the installation component 2 can be disposed according to the installation way required by the illumination module 1 to achieve various installation ways of the illumination module 1.

It should be noted that the back face of the housing 11 refers to a face facing a roof of a house when the illumination module 1 is installed on the roof of the house, for example. The front face of the housing 11 refers to a face facing a floor of the house when the illumination module 1 is installed on the roof of the house, for example.

In order to achieve the above purpose, components of the illumination module 1 can be disposed in various ways. The following illustrates specific embodiments as examples to introduce the construction of the components of the illumination module 1 in detail.

The housing 11 can have a rectangular or circular structure etc. The housing 11 protrudes toward the back face at a position close to one end thereof, to form a power supply accommodation groove 113, and an opening of the power supply accommodation groove 113 is located on the front face of the main body part 114 of the housing 11. The power supply 12 is put into the power supply accommodation groove 113 from the front face of the main body part 114 of the housing 11 to facilitate to arrange the installation component 2 on the back face of the housing 11.

The light source component 13 is installed on a portion of the main body part 114 of the housing 11 other than the power supply accommodation groove 113. The light source component 13 includes a light source module 131, a lens 132, a glass shade 133, and a glass cover plate 134 which are installed in sequence. The light source module 131 includes an LED (Light Emitting Diode) light source module 131, and the LED light source module 131 includes a base substrate, such as a PCB (Printed Circuit Board) and LED lamp beads fixed on the PCB. The LED lamp beads are disposed in an array and the light source module 131 can also include a plurality of sub light source modules disposed in an array. The light source module 131 is installed on the main body part 114 of the housing 11, a front face of the light source module 131 (having the same orientation as the front face of the housing 11) can be substantially flush with a front face of the power supply 12 (having the same orientation as the front face of the housing 11), to reduce a volume of the illumination module 1.

Various schemes for the face shape of the lens 132 can be adopted to satisfy the illumination requirements for different directions and angles. The lenses are disposed corresponding to the LED lamp beads one by one to distribute light of the LED lamp beads. The glass shade 133 is formed by silk-screen printing and then tempering process to enhance the firmness and weatherability of the glass shade 133.

In order to improve the sealing of the illumination module 1, a waterproof silicone ring 14 can also be installed between the main body part 114 of the housing 11 and the glass cover plate 134. Meanwhile, a water joint 15 and a respirator 16 can be installed on the back face of the main body part 114 of the housing 11. The waterproof silicone ring 14 can be an X-shaped waterproof silicone ring 14, which can decrease a compressive stress of the glass shade 133 to achieve effective waterproof and anti-leakage while reducing the risk of explosion.

The installation region 111 includes a first installation part 1111 located on the outer periphery of the back face of the main body part 114 of the housing 11. The first installation part 1111 is disposed on the outer periphery of the back face of the main body part 114 of the housing 11, which can improve the convenience to arrange the installation component 2 and facilitate to arrange other components on the back face of the main body part 114 of the housing 11. For example, a heat sink 17 is disposed on the back face of the main body part 114 of the housing 11, and the heat dissipation efficiency of the illumination module 1 is improved by the heat sink 17.

The heat sink 17 can be disposed in a heat dissipation region 112 on the back face of the main body part 114 of the housing 11. The heat dissipation region 112 is located in the middle of the main body part 114 of the housing 11. The first installation part 1111 surrounds the heat dissipation region 112 to further improve the convenience when arranging the installation component 2 and the heat sink 17.

The heat sink 17 and the main body part 114 of the housing 11 can be an integral structure to facilitate processing. The heat sink 17 can be disposed in various ways. In one example, the heat sink 17 can be heat dissipation fins, and a plurality of the heat dissipation fins are disposed in the heat dissipation region 112. Each of the heat dissipation fins has substantially the same shape, and is a heat dissipation fin having a substantially L-shaped cross section (the cross section is along a direction parallel to the housing 11). With this arrangement, greater heat dissipation efficiency can be obtained, to achieve the weight reduction of the illumination module 1, improve the reliability of the product, and greatly reduce the cost.

The arrangement of the heat dissipation fins can be specifically designed according to requirements. In one example, the heat dissipation region 112 is provided with four groups of heat dissipation fin groups with different orientations and all facing the outside of the main body part 114 of the housing 11. Each of the heat dissipation fin groups has a plurality of heat dissipation fins disposed in sequence and at intervals, and each heat dissipation fin in the same heat dissipation fin group has the same orientation, and increases in size in sequence.

Certainly, in addition to the heat dissipation fins, the heat sink 17 can also be heat dissipation holes disposed in the main body part 114 of the housing 11 etc.

Whether the heat sink 17 is the heat dissipation fin or other structure, an orthographic projection of the heat sink 17 on the main body part 114 of the housing 11 is located in the heat dissipation region 112. In this way, the interference of the heat sink 17 to the installation component 2 located in the first installation part 1111 can be reduced, to facilitate to install various types of installation components 2.

The power supply accommodation groove 113 can be located in the heat dissipation region 112. The heat dissipation fins can also be disposed on an outer groove wall of the power supply accommodation groove 113 to further improve the heat dissipation efficiency of the illumination module 1. The shape of the heat dissipation fins disposed on the power supply accommodation groove 113 can be substantially the same as the shape of the heat dissipation fins disposed on other positions of the heat dissipation region 112, to facilitate processing.

The first installation part 1111 can be disposed in various ways. In one example, the first installation part 1111 is an installation surface with a planar surface, and the installation surface is a side face surrounding the main body part 114 of the housing 11. A connection hole is disposed in the installation surface, and the installation component 2 is fixed to the main body part 114 of the housing 11 by a connector fixed in the connection hole. With this arrangement, the structure is simple, the processing is convenient, and the cost is low. Parameters such as a width of the installation surface can be designed according to requirements.

In addition, the installation region 111 further includes a second installation part 1112 disposed on the side wall of the power supply accommodation groove 113 to further increase an installation way of the illumination module 1. The second installation part 1112 can be a hole-shaped structure disposed on the side wall of the power supply accommodation groove 113. When the installation component 2 is, for example, a rod-shaped installation component 2, the installation component 2 is fixed in the second installation part 1112. A central axis of the hole-shaped structure can be substantially parallel to the surface of the main body part 114 of the housing 11 and substantially perpendicular to the installation surface of the first installation part 1111, so that the illumination module 1 can be used as a street lamp, etc. to increase an application situation of the illumination module 1, and the structure is simple and easy to use.

Certainly, the second installation part 1112 can also be disposed on other side walls of the middle of the housing 1, such as on heat dissipation fins, etc.

The lamp of the present application includes an illumination module 1 and an installation component 2 fixed in the installation region 111 of the illumination module 1. The illumination module 1 is the above-mentioned illumination module 1. In the lamp, the installation component 2 can be disposed according to the installation way required by the illumination module 1 to achieve various installation ways of the lamp.

Figure 5:
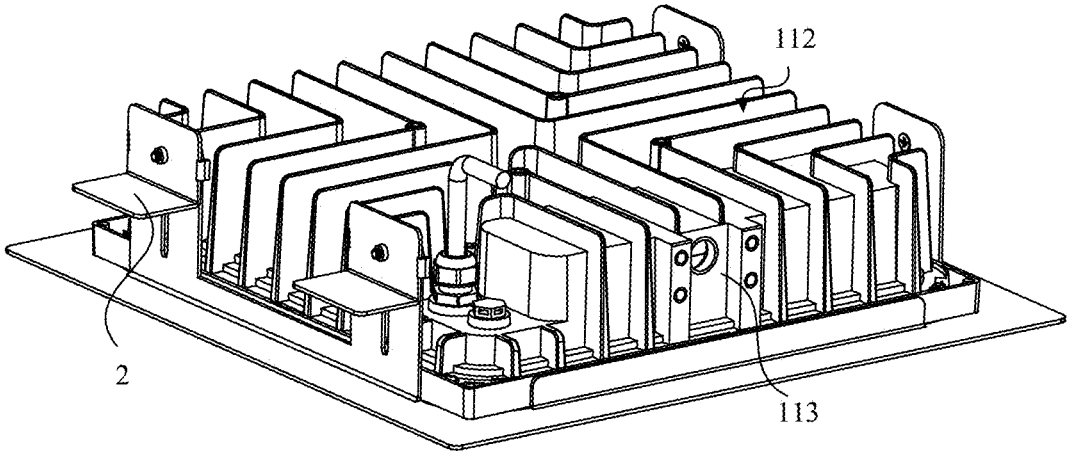
FIG. 5 is a schematic diagram of a first structure of a lamp according to an embodiment of the present application.
Figure 6:
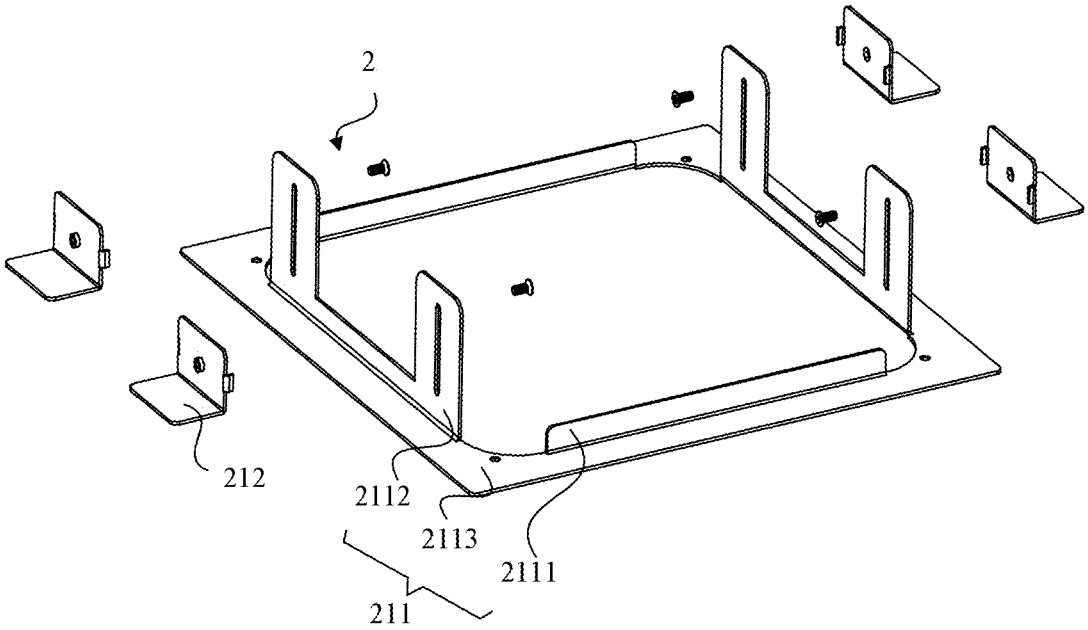
FIG. 6 is a schematic diagram of a first explosion structure of an installation component according to an embodiment of the present application.

The installation component 2 is disposed by various ways. In a first example, as shown in FIG. 5 and FIG. 6, the installation component 2 includes a support 211 fixed in the installation region 111 of the housing 11 and extending toward the back face of the main body part 114 of the housing 11 and connection ears 212 fixed to the support 211. The lamp of the example is an embedded lamp.

The support 211 can include a panel 2111 installed on the first installation part 1111, vertical plates 2112 disposed perpendicular to the panel 2111, and a fixing plate 2113 connected to the panel 2111 and the vertical plates 2112. The connection ear 212 is a substantially L-shaped installation sheet, and one connection ear 212 is installed on each vertical plate 2111. A count of connection ears 212 and vertical plates 2111 can be designed according to requirements. The panel 2111 is fixed to the first installation part 1111 by countersunk head screws. The vertical plates 2112 can be provided with a long and narrow slot perpendicular to the panel 2111, so as to facilitate to adjust the height of the connection ear 212.

When the lamp is installed on a ceiling, a horizontal portion of the connection ear 212 (perpendicular to the vertical plate 2112) is disposed on a ceiling keel or a plane around openings of an installation base. The fixing plate 2113 and the connection ear 212 clamp the ceiling keel or the plane around the openings of the installation base, to fasten the fixing plate 2113 to the ceiling keel, and then the light source component 13 is installed in the main body part 114 of the housing 11. The lamp has an exposed line connection end to connect by the user.

Figure 7:
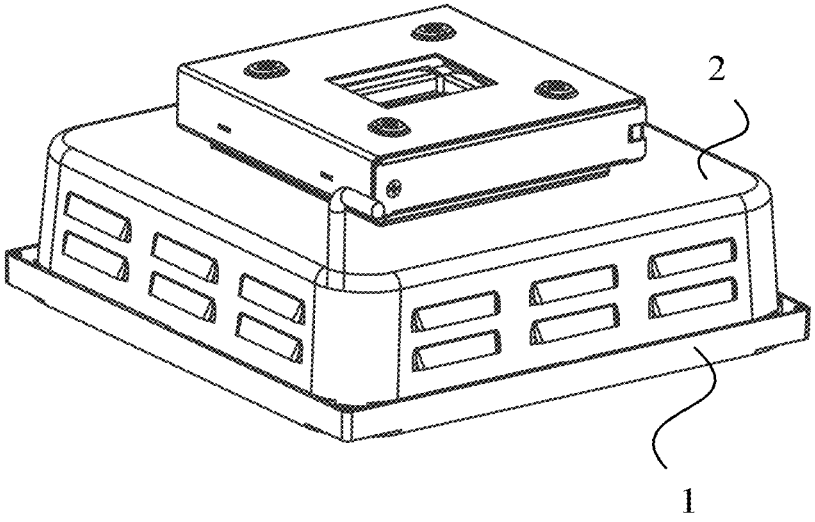
FIG. 7 is a schematic diagram of a second structure of a lamp according to an embodiment of the present application.
Figure 8:
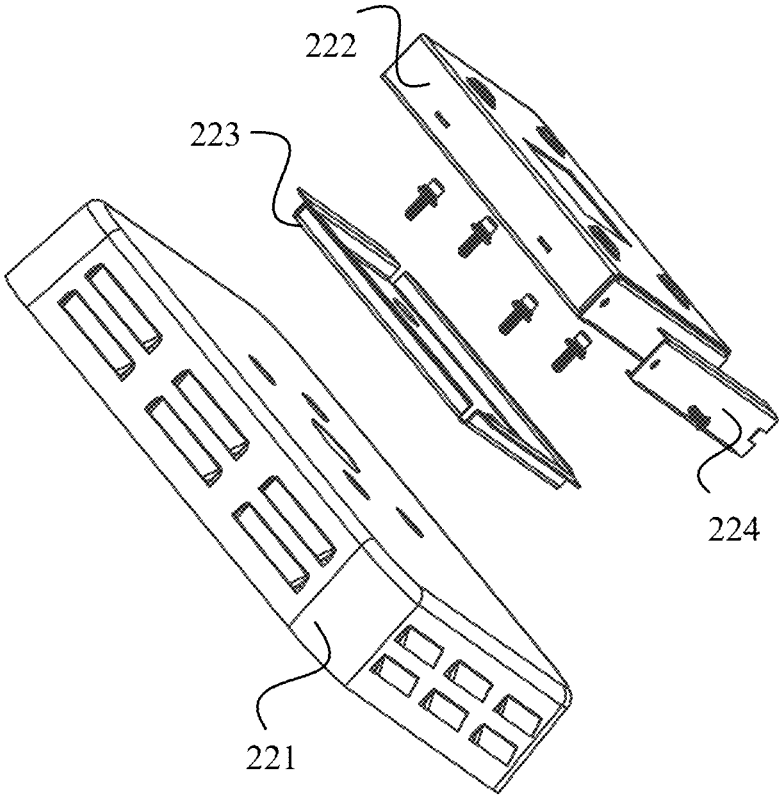
FIG. 8 is a schematic diagram of a second explosion structure of an installation component according to an embodiment of the present application.

In a second example, as shown in FIG. 7 and FIG. 8, the installation component 2 includes a mask 221 fixed in the installation region 111 of the housing 11 and buckled on the back face of the main body part 114 of the housing 11, and a ceiling box 222 fixed to the mask 221. The lamp of the example forms a ceiling lamp.

The mask 221 can have a substantially box-shaped structure, and is fixed to the first installation part 1111 of the housing 11 by, for example, screws. The ceiling box 222 is fixed to the mask 221 by an installation plate 223. The ceiling box 222 is the same as a conventional ceiling box 222 which side is installed with a side plate 224. A power supply line protrudes from a round hole between the mask 221 and the installation plate 223, and is wired in the ceiling box 222.

Figure 9:
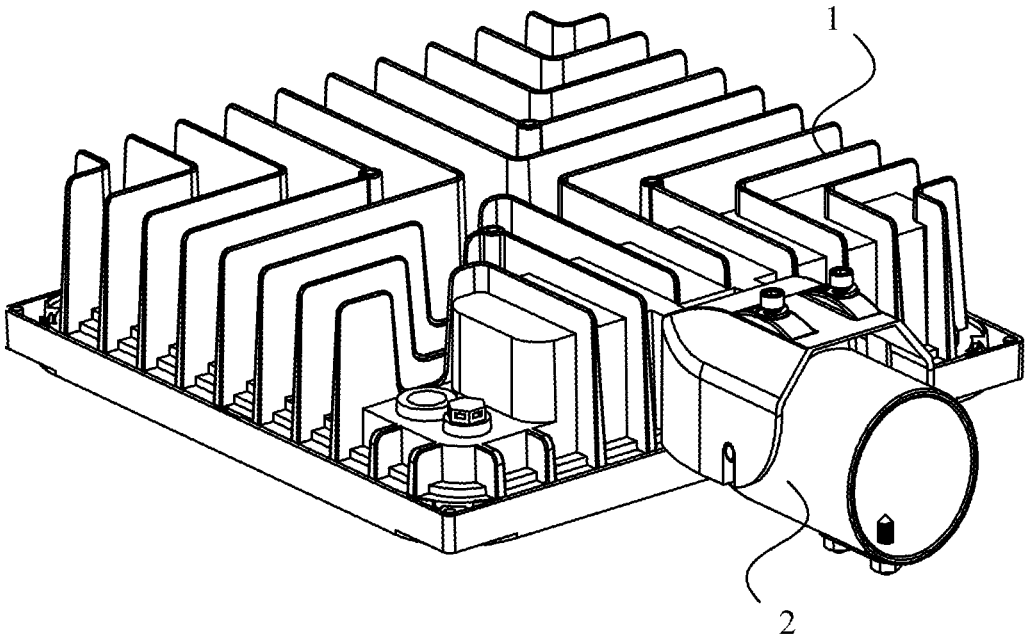
FIG. 9 is a schematic diagram of a third structure of a lamp according to an embodiment of the present application.
Figure 10:
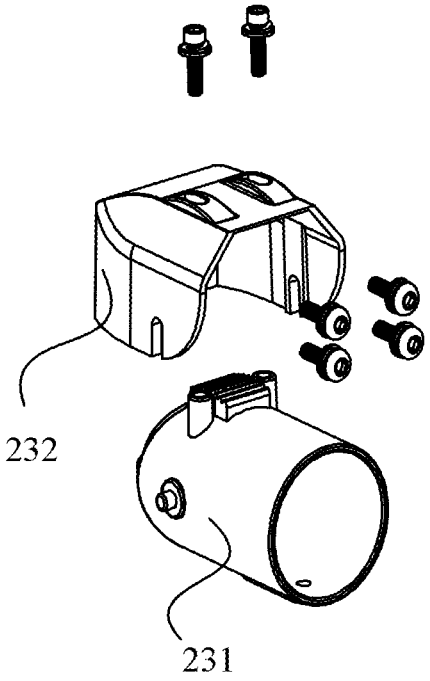
FIG. 10 is a schematic diagram of a third explosion structure of an installation component according to an embodiment of the present application.

In a third example, as shown in FIG. 9 and FIG. 10, the installation component 2 includes a lamp rod 231 fixed in the installation region 111. The lamp of the example is a rod-mounted lamp.

The lamp rod 231 can be a hollow rod, and is fixed to the second installation part 1112 by, for example, a fixing base 232. The second installation part 1112 has an opening for threading, and four screw holes for locking with the lamp rod 231 by screws. The lamp rod 231 can be provided with a threaded hole so that the lamp rod can be installed on a street lamp rod by, for example, screws. The screws can also be provided with locknuts to improve the firmness of the connection between the lamp and the street lamp rod.

The present disclosure may include dedicated hardware implementations such as application specific integrated circuits, programmable logic arrays and other hardware devices. The hardware implementations can be constructed to implement one or more of the methods described herein.

Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the apparatus or system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

Optionally, the first installation part is an installation surface with a planar surface, a connection hole for installing a connector is disposed in the installation surface, and the installation component is fixedly connected to the housing by the connector.

Optionally, the installation surface of the first installation part is a side face surrounding the outer periphery of the main body part of the housing.

Optionally, the second installation part is a hole-shaped structure, an axis of the second installation part is perpendicular to the side face of the first installation part.

Optionally, a heat dissipation region for installing a heat sink is further disposed on the back face of the main body part of the housing, the first installation part surrounds the heat dissipation region, and the second installation part is located in the heat dissipation region.

Optionally, an orthographic projection of each part of the heat sink on the main body part of the housing is located in the heat dissipation region.

Optionally, the heat sink includes a plurality of heat dissipation fins, each of the heat dissipation fins has an L-shaped cross section along a direction parallel to the main body part of the housing.

Optionally, the illumination module further includes a power supply accommodation groove located in the heat dissipation region and protruding toward the back face of the main body part of the housing;

wherein the second installation part is disposed on the side wall of the power supply accommodation groove.

Optionally, the light source component is installed at a portion of the main body part of the housing other than the power supply accommodation groove.

Optionally, the installation component includes a mask fixed to the first installation part and buckled on the back face of the main body part of the housing, and a ceiling box fixed to the mask.

Optionally, the installation component includes a support fixed to the first installation part and extending toward the back face of the main body part of the housing, and a connection ear fixed to the installation support.

Optionally, the installation component includes a lamp rod fixed to the second installation part.

The above is only an embodiment of the present application, and is not intended to limit the present application. For those skilled in the art, the present application can have various modifications and changes. Any modification, equivalent replacement, and improvement, etc. made within the spirit and principle of this application should be included in the scope of the claims of the application.

What is claimed is:

1. An illumination module adapted to be assembled with at least two different installation components, comprising:

a housing, comprising:

a main body part, a side wall extending from the main body part, and an installation region for disposing the installation components, wherein the installation region comprises a first installation part and a second installation part, the first installation part is located on an outer periphery of a back face of the main body part of the housing and configured to be assembled with an installation component that comprises a support panel, wherein the first installation part comprises an installation surface;

the second installation part is located on the side wall at the back face of the housing and configured to be assembled with an installation component, wherein the second installation part comprises a hole-shaped structure that is perpendicular to the installation surface of the first installation part; and a light source component, installed on a front face of the main body part of the housing.

2. The illumination module according to claim 1, wherein the first installation part is an installation surface with a planar surface, a connection hole for installing a connector is disposed in the installation surface, and the installation component is fixedly connected to the housing by the connector.

3. The illumination module according to claim 2, wherein the installation surface of the first installation part is a side face surrounding the outer periphery of the main body part of the housing.

4. The illumination module according to claim 3, wherein the hole-shaped structure of the second installation part comprises an axis that is perpendicular to the side face of the first installation part.

5. The illumination module according to claim 1, wherein a heat dissipation region for installing a heat sink is further disposed on the back face of the main body part of the housing, the first installation part surrounds the heat dissipation region, and the second installation part is located in the heat dissipation region.

6. The illumination module according to claim 5, wherein an orthographic projection of each part of the heat sink on the main body part of the housing is located in the heat dissipation region.

7. The illumination module according to claim 5, wherein the heat sink comprises a plurality of heat dissipation fins, each of the heat dissipation fins has an L-shaped cross section along a direction parallel to the main body part of the housing.

8. The illumination module according to claim 5, further comprising a power supply accommodation groove located in the heat dissipation region and protruding toward the back face of the main body part of the housing;

wherein the second installation part is disposed on the side wall of the power supply accommodation groove.

9. The illumination module according to claim 8, wherein the light source component is installed at a portion of the main body part of the housing other than the power supply accommodation groove.

10. A lamp, comprising the illumination module according to claim 1 and an installation component fixed to the installation region of the illumination module.

11. The lamp according to claim 10, wherein the installation component comprises a mask fixed to the first installation part and buckled on the back face of the main body part of the housing, and a ceiling box fixed to the mask.

12. The lamp according to claim 10, wherein the installation component comprises a support fixed to the first installation part and extending toward the back face of the main body part of the housing, and a connection ear fixed to the installation support.

13. The lamp according to claim 10, wherein the installation component comprises a lamp rod fixed to the second installation part.

14. An illumination module adapted to be assembled with at least two different installation components, comprising:

a housing, comprising:

a main body part, a side wall extending from the main body part, and an installation region for disposing the installation components, wherein the installation region comprises a first installation part and a second installation part, the first installation part is located on an outer periphery of a back face of the main body part of the housing and configured to be assembled with an installation component that comprises a support panel, wherein the first installation part comprises an installation surface;

the second installation part is located on the side wall at the back face of the housing and configured to be assembled with an installation component, wherein the second installation part comprises a hole-shaped structure that is perpendicular to the installation surface of the first installation part to connect the illumination module to a street lamp using a street lamp rod; and a light source component, installed on a front face of the main body part of the housing.

15. The illumination module according to claim 14, wherein the first installation part is an installation surface with a planar surface, a connection hole for installing a connector is disposed in the installation surface, and the installation component is fixedly connected to the housing by the connector.

16. The illumination module according to claim 15, wherein the installation surface of the first installation part is a side face surrounding the outer periphery of the main body part of the housing.

17. The illumination module according to claim 16, wherein the hole-shaped structure of the second installation part comprises an axis that is perpendicular to the side face of the first installation part.

18. The illumination module according to claim 14, wherein a heat dissipation region for installing a heat sink is further disposed on the back face of the main body part of the housing, the first installation part surrounds the heat dissipation region, and the second installation part is located in the heat dissipation region.

19. The illumination module according to claim 18, further comprising a power supply accommodation groove located in the heat dissipation region and protruding toward the back face of the main body part of the housing;

wherein the second installation part is disposed on the side wall of the power supply accommodation groove.

20. The illumination module according to claim 19, wherein the light source component is installed at a portion of the main body part of the housing other than the power supply accommodation groove.

* * * * *